US010583351B2

(12) United States Patent
Lee

(10) Patent No.: US 10,583,351 B2
(45) Date of Patent: Mar. 10, 2020

(54) PUZZLE CUBE AND A METHOD FOR MAKING SAME

(71) Applicant: Jerich Jaewon Lee, Rancho Palos Verdes, CA (US)

(72) Inventor: Jerich Jaewon Lee, Rancho Palos Verdes, CA (US)

( * ) Notice: Subject to any disclaimer, the term of this patent is extended or adjusted under 35 U.S.C. 154(b) by 0 days.

(21) Appl. No.: 16/167,148

(22) Filed: Oct. 22, 2018

(65) Prior Publication Data

US 2020/0023266 A1 Jan. 23, 2020

Related U.S. Application Data

(60) Provisional application No. 62/699,267, filed on Jul. 17, 2018.

(51) Int. Cl.
*A63F 9/08* (2006.01)

(52) U.S. Cl.
CPC .... *A63F 9/0842* (2013.01); *A63F 2009/0846* (2013.01)

(58) Field of Classification Search
CPC ..... A63F 9/0842; A63F 2009/0846; A63F 9/0826; A63F 9/0838
See application file for complete search history.

(56) References Cited

U.S. PATENT DOCUMENTS 4,378,117 A * 3/1983 Rubik ..... A63F 9/0834 273/153 S
4,427,197 A * 1/1984 Doose ..... A63F 9/0842 273/153 S
4,513,970 A * 4/1985 Opresco ..... A63F 9/34 273/153 S
5,271,688 A * 12/1993 Chang ..... A63F 9/0826 403/290
5,826,871 A * 10/1998 Li ..... A63F 9/0834 273/153 S (Continued)

*Primary Examiner* — Steven B Wong
(74) *Attorney, Agent, or Firm* — Byrne Poh LLP

(57) ABSTRACT

A puzzle cube and a method for making same are provided. In some embodiments, a puzzle cube is provided, the puzzle cube comprising: a central core assembly including a center cross member having six arms perpendicular to each other, wherein each arm is connected to an assembly member that connects the center cross member with one of a plurality of center blocks; the plurality of center blocks, wherein each center block includes a plurality of wings formed along a base portion of the center block; a plurality of edge blocks, wherein each edge block includes a ridge structure that is formed to fit with the plurality of wings of the center block; and a plurality of corner blocks, wherein each corner block includes a protrusion structure that is formed to fit with the plurality of wings of the center block, wherein: (i) an edge track assembly that includes an edge track member and an edge holder member is formed on the ridge structure of each edge block; (ii) two protrusion structures of two corner blocks of the plurality of corner blocks are positioned to abut opposing ends of the edge track member of the edge track assembly of the edge block; and (iii) the edge holder member of the edge track assembly stabilizes the two protrusion structures that are positioned to abut opposing ends of the edge track member of the edge track assembly of the edge block.

21 Claims, 12 Drawing Sheets

(56) References Cited

U.S. PATENT DOCUMENTS

| | | | | |
|---|---|---|---|---|
| 5,992,850 | A * | 11/1999 | Li | A63F 9/0826 273/153 S |
| 8,465,356 | B2 * | 6/2013 | Rosendo | A63F 9/0842 273/153 S |
| 2005/0184458 | A1 * | 8/2005 | Sugden | A63F 9/0842 273/153 S |
| 2007/0262522 | A1 * | 11/2007 | Lu | A63F 9/0842 273/153 S |
| 2008/0237981 | A1 * | 10/2008 | Gilles | A63F 9/0842 273/153 S |
| 2009/0127783 | A1 * | 5/2009 | Paquette | A63F 9/0834 273/153 S |
| 2012/0248696 | A1 * | 10/2012 | Wu | A63F 9/0861 273/153 S |
| 2015/0076766 | A1 * | 3/2015 | Liu | A63F 9/0826 273/153 S |

* cited by examiner

PUZZLE CUBE AND A METHOD FOR MAKING SAME

CROSS-REFERENCE TO RELATED APPLICATIONS

This application claims the benefit of U.S. Provisional Patent Application No. 62/699,267, filed Jul. 17, 2018, which is hereby incorporated by reference herein in its entirety.

TECHNICAL FIELD

The disclosed subject matter relates to a puzzle cube. More particularly, the disclosed subject matter relates to a puzzle cube that includes multiple corner blocks, multiple edge blocks, and multiple center blocks, where a center block includes wing features that are formed to fit with protruding features on a corner block and where an edge block includes ridge features that are formed to fit with the wing features on the center block.

BACKGROUND

Conventional puzzle cubes (sometimes referred to as magic cubes) have a central shaft and multiple blocks mounted on the central shaft in which the multiple blocks are pivotally rotatable with respect to the central shaft to generate diversified puzzles. Different colors and/or patterns are formed on the sides of each block. To solve a puzzle cube, users must rotate the blocks of the cube puzzle until each side of the puzzle cube shows a same color.

In a particular example, a conventional puzzle cube is a square cube having six sides each composed of nine moveable smaller surfaces arranged in three layers (3×3). Normally, the six sides of the square cube each have a different color—that is, the nine smaller blocks on one side are respectively in one color. When any layer is rotated to change the positions of the corresponding blocks, the small moveable areas on every side in this layer are moved respectively to another side of a different color, and the resulting sides have miscellaneous colors. The way to play with a conventional puzzle cube is to mix up the colors of the six sides of the puzzle cube and then to rotate the layers of the cube to move every group of moveable areas having the same color to their appropriate side, until each of the six sides of the square cube has its respective singular color.

There are, however, many instances (e.g., particularly in speedcubing or speed solving applications) in which these puzzle cubes fail. For example, a puzzle cube may not be properly tensioned, which can result in the blocks of a puzzle cube locking up or the blocks of a puzzle cube popping out from the remainder of the puzzle cube. To improve the performance of a puzzle cube, some users attempt to alleviate these issues by apply a lubricant to modify the amount of friction when manipulating a puzzle cube. For example, a lubricant (e.g., a lubricant having a high viscosity) can be applied that reduces the speed of the rotations when manipulating a puzzle cube, thereby making the puzzle cube more controllable by the user of the puzzle cube. In another example, a lubricant can be applied that reduces the amount of friction to increase the speed of the rotations when manipulating a puzzle cube.

Accordingly, it is desirable to provide a new puzzle cube and a method for making the same that alleviate the above-mentioned issues.

SUMMARY

In accordance with various embodiments of the disclosed subject matter, a puzzle cube and a method for making same are provided.

In accordance with some embodiments of the disclosed subject matter, a puzzle cube is provided, the puzzle cube comprising: a central core assembly including a center cross member having six arms perpendicular to each other, wherein each arm is connected to an assembly member that connects the center cross member with one of a plurality of center blocks; the plurality of center blocks, wherein each center block includes a plurality of wings formed along a base portion of the center block; a plurality of edge blocks, wherein each edge block includes a ridge structure that is formed to fit with the plurality of wings of the center block; and a plurality of corner blocks, wherein each corner block includes a protrusion structure that is formed to fit with the plurality of wings of the center block, wherein: (i) an edge track assembly that includes an edge track member and an edge holder member is formed on the ridge structure of each edge block; (ii) two protrusion structures of two corner blocks of the plurality of corner blocks are positioned to abut opposing ends of the edge track member of the edge track assembly of the edge block; and (iii) the edge holder member of the edge track assembly stabilizes the two protrusion structures that are positioned to abut opposing ends of the edge track member of the edge track assembly of the edge block.

In some embodiments, the assembly member is a screw having a screw head and wherein each arm in the center cross member receives the screw.

In some embodiments, the puzzle cube further comprises a lid structure that covers an interior of the center block in which the screw connects the base portion of the center block with an arm of the center cross member.

In some embodiments, the puzzle cube further comprises a compression spring that is positioned between the screw head of the screw and the base portion of the center block.

In some embodiments, each of the plurality of wings of the center block is formed along an edge of the base portion of the center block.

In some embodiments, the ridge structure formed on each of the plurality of edge blocks includes a plate lip structure that is formed beneath the edge track assembly, where a surface of the plate lip structure abuts the plurality of wings of the center block.

In some embodiments, the protrusion structure of each of the plurality of corner blocks includes a corner block base formed on a post member extending from the corner block and wherein each corner block base from the plurality of corner blocks, when positioned to abut the edge track member of each of the plurality of edge blocks, and each plate lip structure from the plurality of edge blocks forms a spherical core that surrounds the central core assembly.

In some embodiments, each of the plurality of corner blocks includes a plurality of extrusions that are formed in an interior portion of the corner block, where the plurality of extrusions inhibit the corner block from performing a twisting motion when being rotated about the central core assembly.

In some embodiments, the protrusion structure of each of the plurality of corner is cup-shaped, where an outer surface of the cup-shaped protrusion structure is formed to fit with the plurality of wings of the center block.

In some embodiments, a first plurality of magnetic elements are positioned within each corner block of the plurality of corner blocks and a second plurality of magnetic elements are positioned within each edge block of the plurality of edge blocks. In some embodiments, at least a first magnetic element of the first plurality of magnetic elements positioned within each corner block of the plurality of corner blocks is positioned to align with at least a second magnetic element of the second plurality of magnetic elements positioned within each edge block of the plurality of edge blocks. In some embodiments, the first magnetic element and the second magnetic element are configured to magnetically couple such that corresponding blocks are configured to rotate a particular amount about the central core assembly. In some embodiments, the first magnetic element and the second magnetic element have opposing polarities such that an attractive force is generated between the first magnetic element and the second magnetic element.

In some embodiments, the protrusion structure of each of the plurality of corner blocks includes the first plurality of magnetic elements. In some embodiments, the protrusion structure of each of the plurality of corner is cup-shaped, where a plurality of magnetic insertion regions are formed within the cup-shaped protrusion structure and where each magnetic element in the first plurality of magnetic elements is placed within each of the plurality of magnetic insertion regions. In some embodiments, three magnetic insertion regions are formed within the cup-shaped protrusion structure that each accommodates one magnetic element of the first plurality of magnetic elements.

In some embodiments, the ridge structure formed on each of the plurality of edge blocks includes a plate lip structure that is formed beneath the edge track assembly, where a plurality of magnetic insertion regions are formed within a bottom face of the plate lip structure, and wherein each magnetic element in the second plurality of magnetic elements is placed within each of the plurality of magnetic insertion regions. In some embodiments, two magnetic insertion regions are formed within the bottom face of the plate lip structure that each accommodates one magnetic element of the second plurality of magnetic elements.

In some embodiments, each of the plurality of center blocks has one face, each of the plurality of edge blocks has two faces, and each of the plurality of corner blocks has three faces.

In some embodiments, the puzzle cube includes six center blocks of the plurality of center blocks, twelve edge blocks of the plurality of edge blocks, and eight corner blocks of the plurality of corner blocks.

In accordance with some embodiments of the disclosed subject matter, a puzzle cube is provided, the puzzle cube comprising: a central core assembly including a center cross member having six arms perpendicular to each other, wherein each arm is connected to an assembly member that connects the center cross member with one of a plurality of center blocks; the plurality of center blocks; a plurality of edge blocks, wherein each edge block includes a first puzzle connection structure, wherein a first magnetic region is formed within the first puzzle connection structure, and wherein a first magnet is positioned within the first magnetic region; and a plurality of corner blocks, wherein each corner block includes a second puzzle connection structure, wherein a second magnetic region is formed within the second puzzle connection structure, and wherein a second magnet is positioned within the second magnetic region; wherein: (i) the first puzzle connection structure of one of the plurality of edge blocks and the second puzzle connection structure of one of the plurality of corner blocks are positioned to connect with one of the plurality of center blocks; and (ii) the first magnet positioned within the first magnetic region is aligned with the second magnet positioned within the second magnetic region.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

Figure 1:
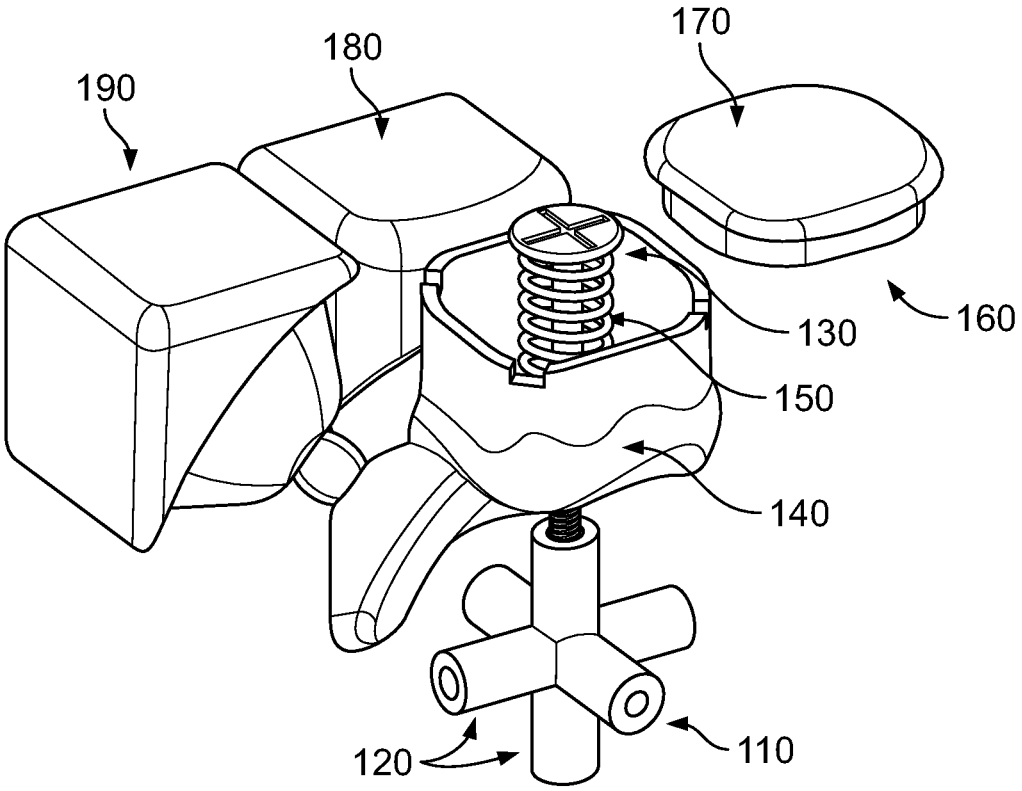
FIG. 1 shows an illustrative example of a puzzle cube that includes (i) a central core assembly that is connected to a center block via an assembly member and (ii) a corner block and an edge block formed to abut wing features formed on the center block in accordance with some embodiments of the disclosed subject matter.

In accordance with various embodiments, a puzzle cube and methods for making the same are provided.

Generally speaking, the puzzle cube can include a central core assembly, multiple center blocks, multiple edge blocks, and multiple corner blocks that are fitted together to form the puzzle cube having a spherical inner core. It should be noted that, in a 3×3 puzzle cube described herein, such a puzzle cube can include six center blocks, twelve edge blocks, and eight corner blocks, where each center block has one face, each edge block has two faces, and each corner block has three faces (for a total of fifty-four faces on the puzzle cube or nine faces per side of the puzzle cube).

In some embodiments, a puzzle cube can include a central core assembly. The central core assembly can include a center cross member having six arms that are perpendicular to one another, where each arm is connected to an assembly member that connects an arm of the center cross member with a center block of the puzzle cube.

It should be noted that a 3×3 puzzle cube can include six center blocks that are each attached to one of the six arms or extensions of the center cross member.

In some embodiments, the assembly member is a screw having a screw head and each arm or extension in the center cross member can receive the screw. For example, the assembly member can attach a center block via a through hole in a base portion of the center block with a receiving portion of the arm or extension of the center cross member. In another example, when attaching the center block to an arm of the center cross member, the screw can be tightened to a particular position from the base portion of the center block.

In some embodiments, the assembly member can include a spring, such as a compression spring or any other suitable elastic material, that is disposed between the screw head of the assembly member and the base portion of the center block.

In some embodiments, the center block can include a lid structure that covers an interior of the center block in which the assembly member connects the base portion of the center block with an arm of the center cross member.

In some embodiments, the center block of the puzzle cube can include multiple wing features formed at the base portion of the center block. For example, the wing features can be formed along an edge of the base portion of the center block and the wing features can be formed to accommodate the positioning of multiple corner blocks and multiple edge blocks with a center blocks when assembling the puzzle cube. In a more particular example, the wing features can be formed to accommodate a protrusion structure of a corner block and a ridge structure of an edge block.

In some embodiments, the puzzle cube can include multiple edge blocks, where each edge block includes a ridge structure that is formed to fit with the wing features of the center block. For example, the ridge structure can include an edge track assembly that includes an edge track member and an edge holder member. In a more particular example, protrusion structures from two corner blocks can be positioned on opposing ends of the edge track member and the edge holder member can hold or otherwise stabilize the protrusion structures of the two corner blocks in place. In another example, the ridge structure can include a plate lip structure that is formed beneath the edge track assembly, where a surface of the plate lip structure abuts the wing features of the center block.

It should be noted that a 3×3 puzzle cube can include twelve edge blocks each having a ridge structure that abuts the wing features of a center block. For example, each center block can have two edge blocks that each include ridge structures that abut the wing features of the center block. In another example, each of the lower layer, the middle layer, and the upper layer of the puzzle cube can each include four edge blocks.

In some embodiments, the puzzle cube can include multiple corner blocks, where each corner includes a protrusion structure that is formed to fit with the wing features of the center block. For example, in some embodiments, the protrusion structure includes a cup-shaped corner block base that is positioned on a post member extending from the corner block.

In some embodiments, the corner block can include multiple extrusions or extrusion regions that are formed in an interior portion of the corner block, where the extrusions inhibit the corner block from performing a twisting motion when being rotated about the central core assembly. This is sometimes referred to as an anti-twist extrusion of the corner block.

It should be noted that a 3×3 puzzle cube can include eight corner blocks.

It should be also noted that, when assembling the puzzle cube, the multiple protrusion structures from each of the multiple corner blocks and the multiple ridge structures from each of the multiple edge blocks forms a spherical core that surrounds the central core assembly.

In some embodiments, the puzzle cube can include magnetic elements positioned within particular elements of the puzzle cube. For example, in some embodiments, a first set of magnetic elements can be placed or affixed in magnetic insertion regions formed within the protrusion structure of a corner block and a second set of magnetic elements can be placed or affixed in magnetic insertion regions formed within the ridge structure of an edge block. In a more particular example, each magnetic insertion region can be formed to accommodate the placement of a magnetic element (e.g., which can be replaced with magnetic elements of varying strength, varying polarities, etc.).

In some embodiments, the magnetic insertion regions in each of the corner blocks and the edge blocks can be formed such that a magnetic element placed within a corner block can align with a magnetic element placed within an edge block. In continuing this example, the magnetic element placed within the corner block can magnetically couple with the magnetic element placed within the edge block such that the corresponding edge and corner blocks are configured to rotate a particular amount about the central core assembly. It should be noted that the magnetic element placed within the corner block and the magnetic element placed within the edge block can have opposing polarities such that an attractive force is generated between the magnetic elements.

It should be noted that the magnetic insertion regions can be formed at any suitable location on each of the corner blocks and each of the edge blocks. For example, the magnetic insertion regions in a corner block can be distributed around the corner block base of the protrusion structure. Alternatively, in another example, the corner block base of the protrusion structure can include a single magnetic insertion region that receives one magnetic element. In another example, the magnetic insertion region in an edge block can be formed beneath the edge track assembly, where one or more magnetic insertion regions are formed within a bottom face of the plate lip structure.

These and other features are further described in connection with FIGS. 1-15.

Turning to FIG. 1, a puzzle cube can include a central core assembly. The central core assembly can include a center cross member 110 having six arms or core extensions 120 that are perpendicular to one another (e.g., as in a three-dimensional Cartesian coordinate axis), where each arm 120 is connected to an assembly member 130 that connects an arm 120 of the center cross member 110 with a center block 140 of the puzzle cube.

In a more particular example, when assembling a 3×3 puzzle cube using center cross member 110, the puzzle cube can include six center blocks 140 that are each attached to one of the six arms or extensions 120 of the center cross member 110.

In some embodiments, assembly member 130 can be any suitable member for attaching center block 140 to center cross member 110, where arm or extension 120 of center cross member 110 can be configured to receive assembly member 130. For example, as shown in FIG. 1, assembly member 130 is shown as a screw having a screw head, where arm or extension 120 of center cross member 110 can receive the screw by having screw threads within arm or extension 120. In a more particular example, as also shown in FIG. 1, assembly member 130 (e.g., a screw) can attach center block 140 to center cross member 110, where assembly member 130 is inserted through a through hole in a base portion of center block 140 and into a receiving portion of arm or extension 120 of center cross member 110.

It should be noted that assembly member 130 can be tightened to a particular position from the base portion of center block 149.

In some embodiments, assembly member 130 can include a spring 150, such as a compression spring or any other suitable elastic material, that is disposed between the screw head of assembly member 130 and the base portion of center block 140. For example, an outer diameter of spring 150 can be selected such that it is less than an outer diameter of the screw head of assembly member 130, which can cause spring 150 to be positioned between the screw head of assembly member 130 and an interior base portion of center block 140. Additionally or alternatively, a spacer, a washer, or a gasket can be inserted between the screw head of assembly member 130 and spring 150, thereby increasing the outer diameter of the screw head.

The one or more springs within each center block 140 can, for example, allow a user of the puzzle cube to modify or adjust the tension of the puzzle cube (e.g., particularly in speed cubing applications or speed solving applications). In a more particular example, a user can remove the lid structure of center block 140 of the puzzle cube and can replace spring 150 with another spring having different properties (e.g., differing spring constant, differing stiffness, differing strength, etc.). In another more particular example, a user can remove the lid structure of center block 140 of the puzzle cube and can adjust the tension of the puzzle cube by tightening or loosening assembly member 130.

In some embodiments, center block 140 can include a lid structure 160 that covers an interior of the center block in which assembly member 130 (including a head portion and spring 150 disposed between the head portion and the interior base portion) connects the base portion of center block 140 with arm 120 of center cross member 110. For example, as shown in FIG. 1, lid structure 160 can form a face 170 of center block 140. In turn, a sticker, such as a sticker having a particular color, can be affixed to face 170 of center block 140 when assembling the puzzle cube. Additionally or alternatively to affixing a sticker on face 170 of center block 140, center block 140 can be formed to have a particular color (e.g., a red colored center block, a center block having a red colored face portion, etc.).

Figure 2:
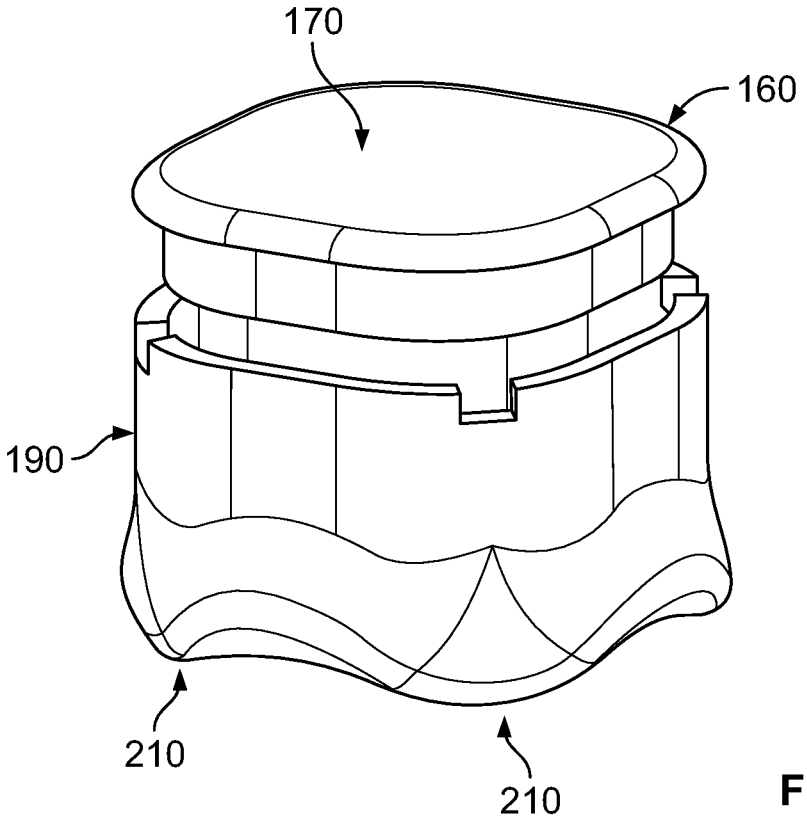
FIG. 2 shows an illustrative example of a center block of the puzzle cube that includes (i) wing features that supports corner blocks and edge blocks and (ii) a lid structure that forms a face of the center block in accordance with some embodiments of the disclosed subject matter.

As shown in FIGS. 1 and 2, each center block 140 of the puzzle cube can include wing features 210 that are formed along an edge of the base portion of center block 140. As shown in FIG. 2, each edge of the base portion of center block 140 can include a wing feature 210, which is raised from the lower edge of center block 140 and protrudes away from the base portion of center block 140.

Referring back to FIG. 1, wing features 210 on each center block 140 can be used to accommodate the positioning of multiple edge blocks, such as an edge block 180, and multiple corner blocks, such as a corner block 190, when assembling the puzzle cube. As described hereinbelow, wing features 210 on each center block 140 can be formed to accommodate an outer surface portion of a protrusion structure on corner block 190 and a surface portion of a ridge structure on edge block 180.

Figure 3A:
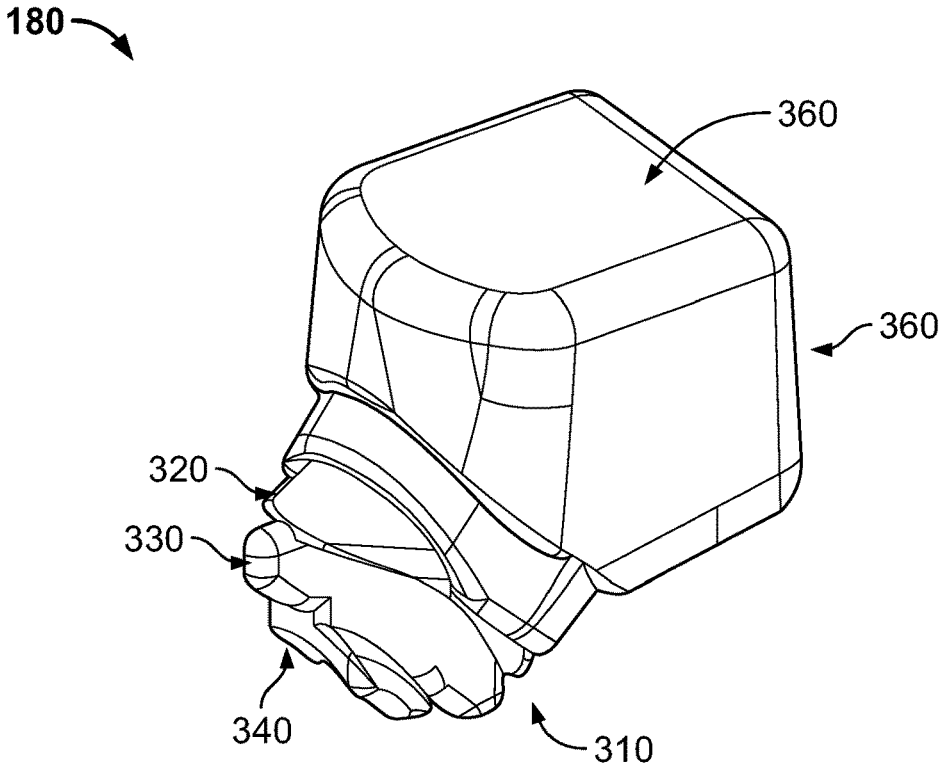
FIG. 3A shows an illustrative view of an edge block of the puzzle cube that includes a ridge structure, where the ridge structure includes (i) a plate lip structure and (ii) an edge track assembly having an edge track member and an edge holder member in accordance with some embodiments of the disclosed subject matter.
Figure 3B:
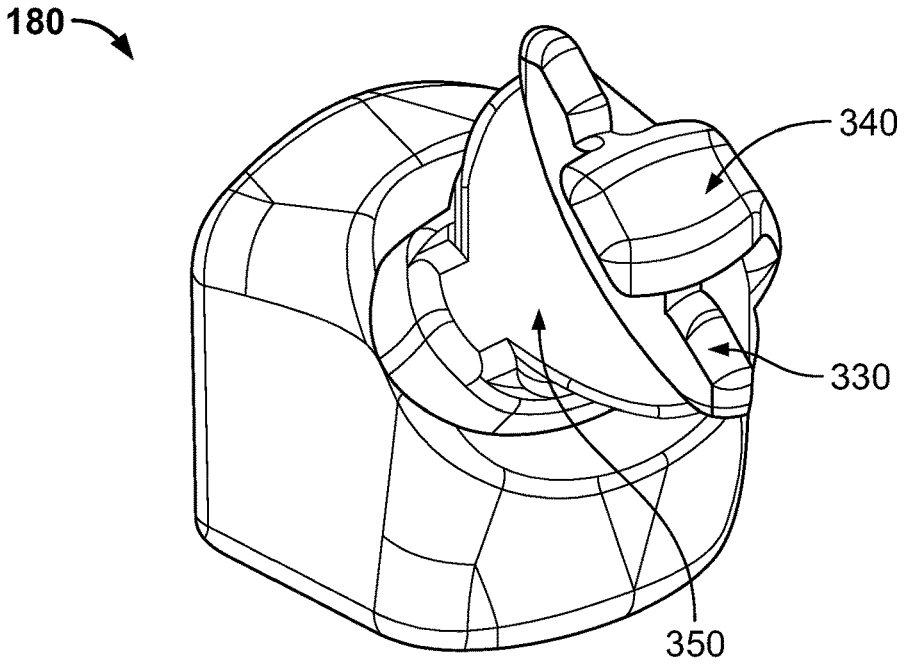
FIG. 3B shows an illustrative view of an edge block of the puzzle cube that shows the edge holder member of the edge track assembly of FIG. 3A and a surface of the plate lip structure of FIG. 3A in accordance with some embodiments of the disclosed subject matter.

Turning to FIGS. 3A and 3B, FIGS. 3A and 3B show illustrative views of an edge block 180 of the puzzle cube in accordance with some embodiments of the disclosed subject matter. As shown in FIGS. 3A and 3B, edge block 180 can include two faces 360. In some instances, a sticker, such as a sticker having a particular color, can be affixed to face 360 of edge block 180 when assembling the puzzle cube. For example, a sticker having one color can be affixed to one face 360 of edge block 180 and a sticker having a differing color can be affixed to the other face 360 of edge block 180. Additionally or alternatively to affixing a sticker on face 360 of edge block 180, edge block 180 can be formed to have one or more particular colors on faces 360 (e.g., an edge block having a red colored face portion and a blue colored face portion).

Figure 5:
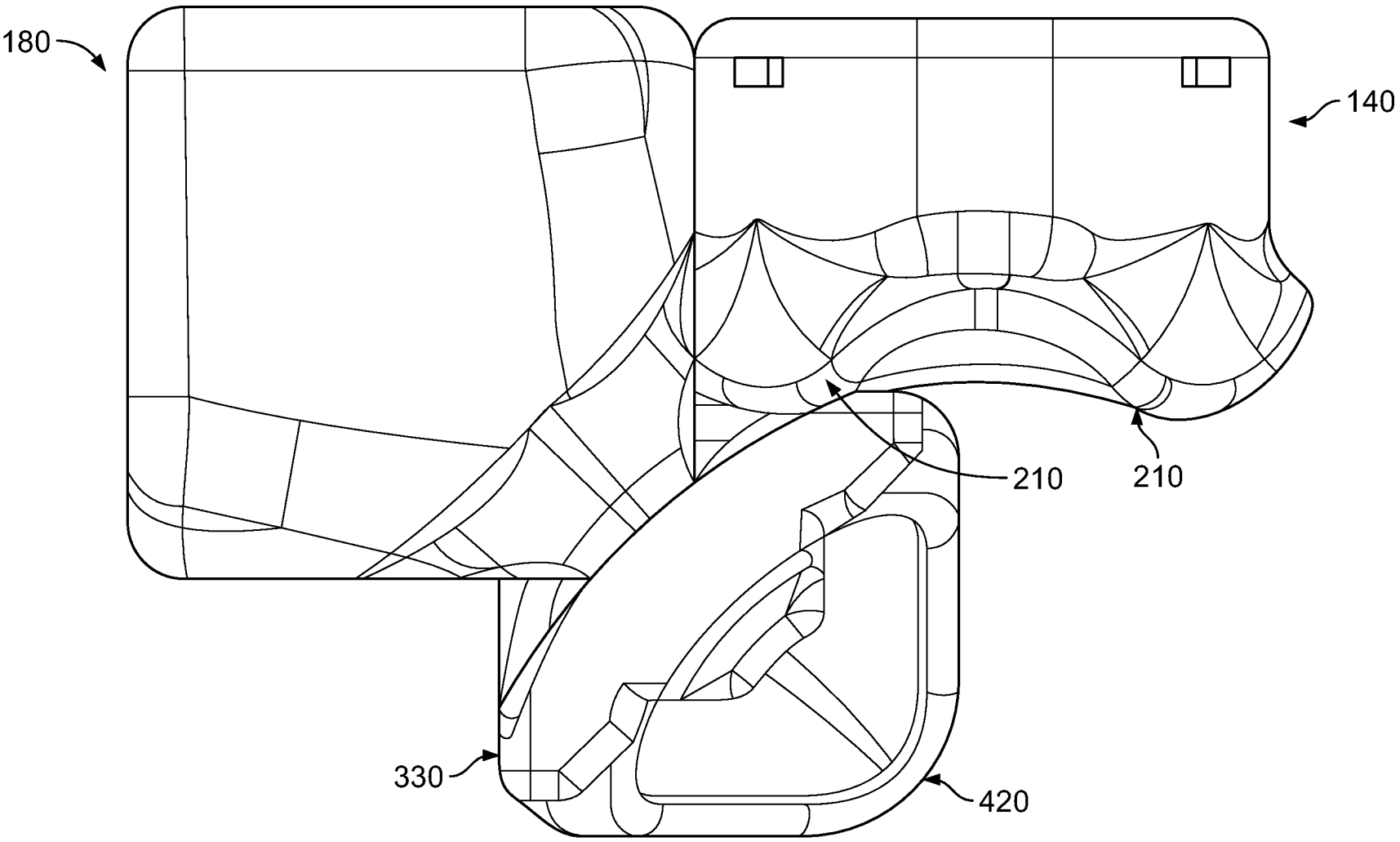
FIG. 5 shows an illustrative example of an edge block and a corner block that are positioned to abut a center block, where the protrusion structure of the corner block is positioned to fit with the wing features of the center block and the ridge structure of the edge block in accordance with some embodiments of the disclosed subject matter.
Figure 6B:
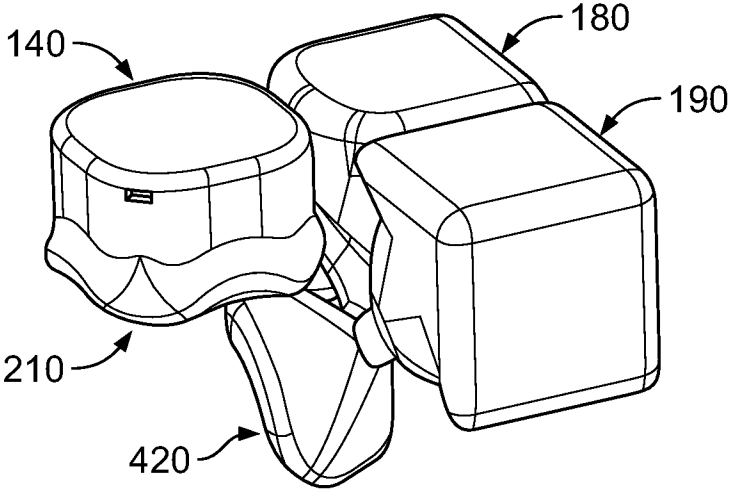
FIGS. 6A and 6B shows multiple views of an edge block and a corner block that are positioned to fit with the wing features of the center block in accordance with some embodiments of the disclosed subject matter.
Figure 6A:
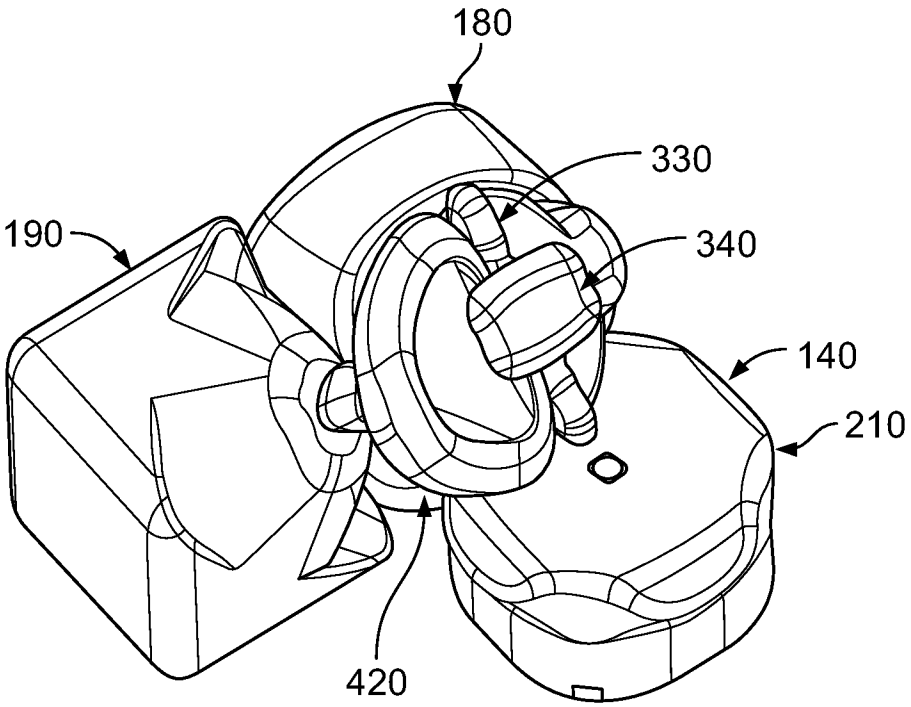

As shown in FIG. 3A, edge block 180 can include a ridge structure 310, where a portion of ridge structure 310 is formed to fit with wing features 210 of center block 140. The fitting of ridge structure 310 of edge block 180 with wing features 210 of center block 140 is also shown in FIGS. 5, 6A, and 6B.

In some embodiments, ridge structure 310 of edge block 180 can include a plate lip structure 320. For example, plate lip structure 320 can be formed to fit underneath wing features 210 of center block 140. As shown in FIG. 3A, plate lip structure 320 can extend outwardly from ride structure 310 such that an outer surface of plate lip structure can be disposed beneath and can abut one of wing features 210 on center block 140.

As shown in FIG. 3B, plate lip structure 320 can have an inner surface 350 upon which an edge assembly can be formed. As shown in FIGS. 3A and 3B, the edge assembly can include an edge track member 330 and an edge holder member 340 in some embodiments.

Figure 7:
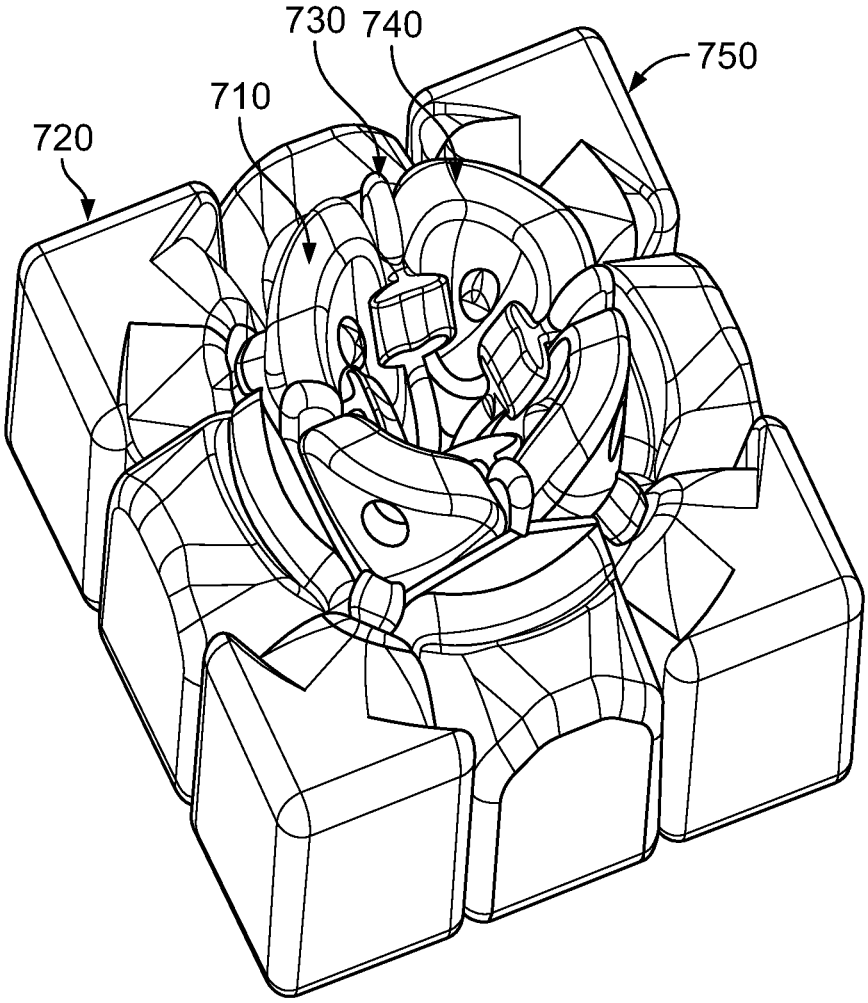
FIG. 7 shows an illustrative example of a layer of the puzzle cube where multiple edge blocks, multiple corner blocks, and multiple center blocks are fitted together, where the edge holder member of the edge track assembly formed on the edge block can hold together protrusion structures of two corner blocks that are positioned on opposing ends of the edge holder member, in accordance with some embodiments of the disclosed subject matter.

It should be noted that edge track member 330 of the edge assembly can be used to support protrusion structures of multiple corner blocks 190. For example, as shown in FIG. 6A, a protrusion structure on corner block 190 can be disposed on inner surface 350 of plate lip structure 320 and against one end of edge track member 330. In another example, as shown in FIG. 7, a first protrusion structure 710 on a first corner block 720 can be disposed on one end against left side of edge track member 730 and a second protrusion structure 740 on a second corner block 750 can be disposed on an opposing end against a right side of edge track member 730.

It should also be noted that edge holder member 340 of the edge assembly can be used to hold and/or otherwise stabilize the protrusion structures of multiple corner blocks 190. For example, as shown in FIG. 6A, a protrusion structure on corner block 190 can be disposed on inner surface 350 of plate lip structure 320 and against one end of edge track member 330, where the protrusion structure of corner block 190 can be stabilized in position by edge holder member 340. In another example, as shown in FIG. 7, first protrusion structure 710 on first corner block 720 can be disposed on one end against left side of edge track member 730 and second protrusion structure 740 on second corner block 750 can be disposed on an opposing end against a right side of edge track member 730, where first protrusion structure 710 of first corner block 720 and second protrusion structure 740 of second corner block 750 are both stabilized in position by edge holder member 730.

In using edge blocks having these ridge structures, it should be noted that a 3×3 puzzle cube can include twelve edge blocks each having a ridge structure that abuts the wing features of a center block. For example, each center block can have two edge blocks that each include ridge structures that abut the wing features of the center block. In another example, each of the lower layer, the middle layer, and the upper layer of the puzzle cube can each include four edge blocks.

Figure 4A:
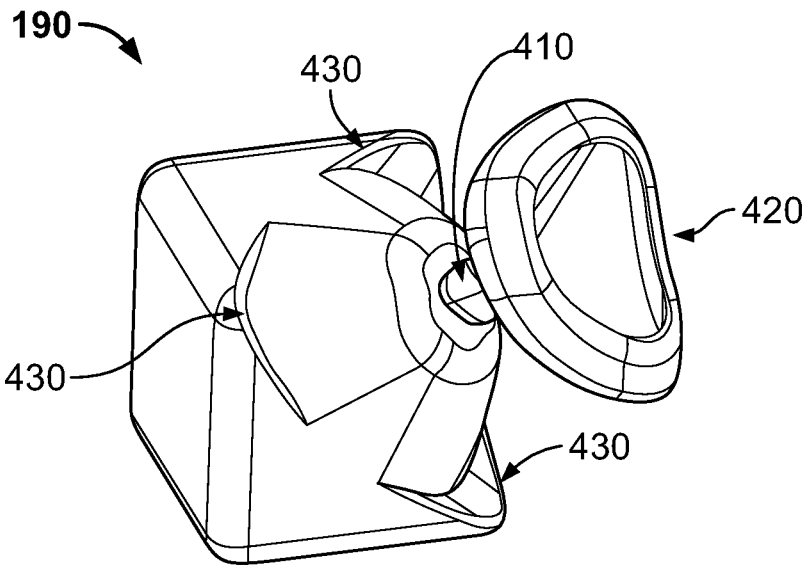
FIG. 4A shows an illustrative view of a corner block of the puzzle cube that includes (i) a protrusion structure that is formed to fit with the wing features of the center block and (ii) multiple extrusions that are formed proximal to a corner portion of the corner block in accordance with some embodiments of the disclosed subject matter.
Figure 4B:
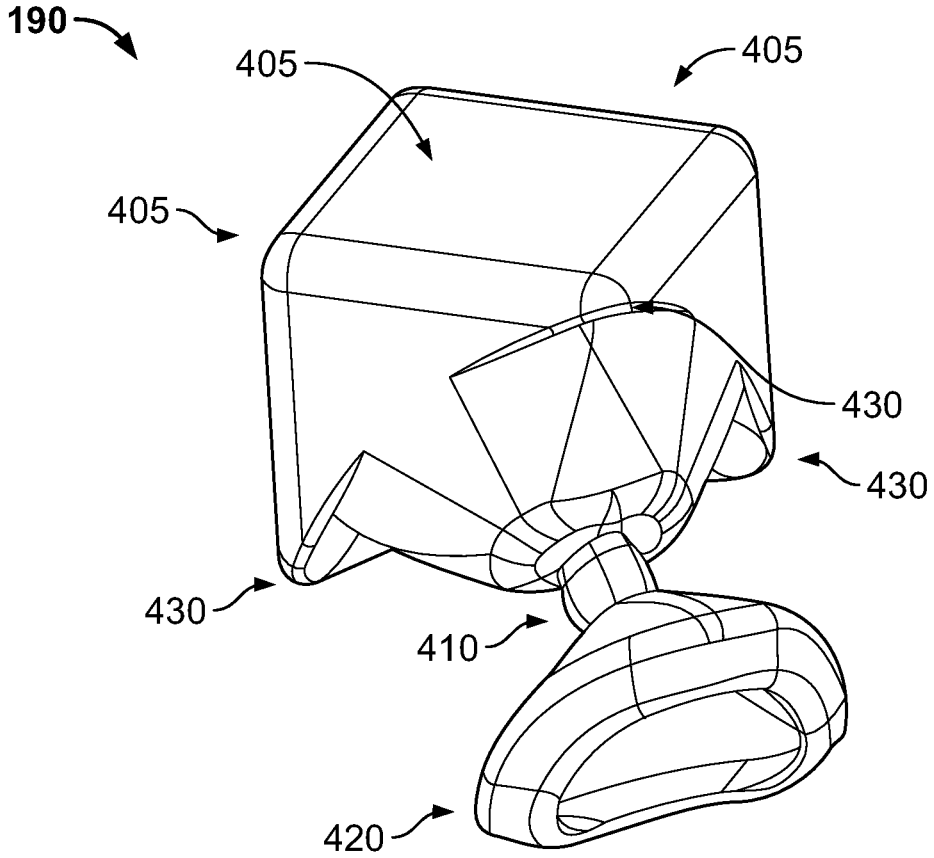
FIG. 4B shows an illustrative view of a corner block of the puzzle block shown in FIG. 4A, where the corner block includes three faces, in accordance with some embodiments of the disclosed subject matter.

Turning to FIG. 4A, FIG. 4A shows an illustrative view of a corner block 190 of the puzzle cube in accordance with some embodiments of the disclosed subject matter. As shown in FIG. 4A, corner block 190 can include a protrusion structure that is formed to fit with wing features 210 on center block 140. As also shown in FIG. 4A, corner block 190 can include one or more extrusions, such as anti-twist extrusions, that are formed at multiple corners of corner block 190. As shown in FIG. 4B, corner block 190 can include three faces 405. In some instances, a sticker, such as a sticker having a particular color, can be affixed to faces 405 of corner block 190 when assembling the puzzle cube. For example, a sticker having a first color can be affixed to a first face 405 of corner block 190, a sticker having a second color can be affixed to a second face 405 of corner block 190, and a sticker having a third color can be affixed to a third face 405 of corner block 190. Additionally or alternatively to affixing a sticker on face 405 of corner block 190, corner block 190 can be formed to have one or more particular colors on faces 405 (e.g., an corner block having a red colored face portion, a blue colored face portion, and a yellow colored face portion).

As shown in FIG. 4A, corner block 190 can include a protrusion structure that includes a post member 410 extending from corner block 190 and a corner block base 420 formed at an end of post member 410. Corner block base 420 can be formed such that the protrusion structure fits with wing features 210 on center block 140. For example, as shown in FIGS. 4A and 4B, the protrusion structure on corner block 190 can include a cup-shaped corner block base 420. In another example, corner block base 420 of the protrusion structure can be any suitable shape to fit with wing features 210 on center block 140. In yet another example, as shown in FIG. 7, when the protrusion structures and, more particularly, corner block bases 420 of protrusion structures from four corner blocks on a top layer or a bottom layer of the puzzle cube are assembled together (along with the ridge structures including the edge track members from multiple edge blocks), the four protrusion structures can form a hemisphere of the spherical core that surrounds the central core assembly. An illustrative top-down view of the lower layer of the puzzle cube that shows the interaction between multiple corner block bases 420 from multiple corner blocks and multiple edge track members from multiple edge blocks to form a hemisphere of the spherical core that surrounds the central core assembly is shown in FIG. 7.

Figure 8:
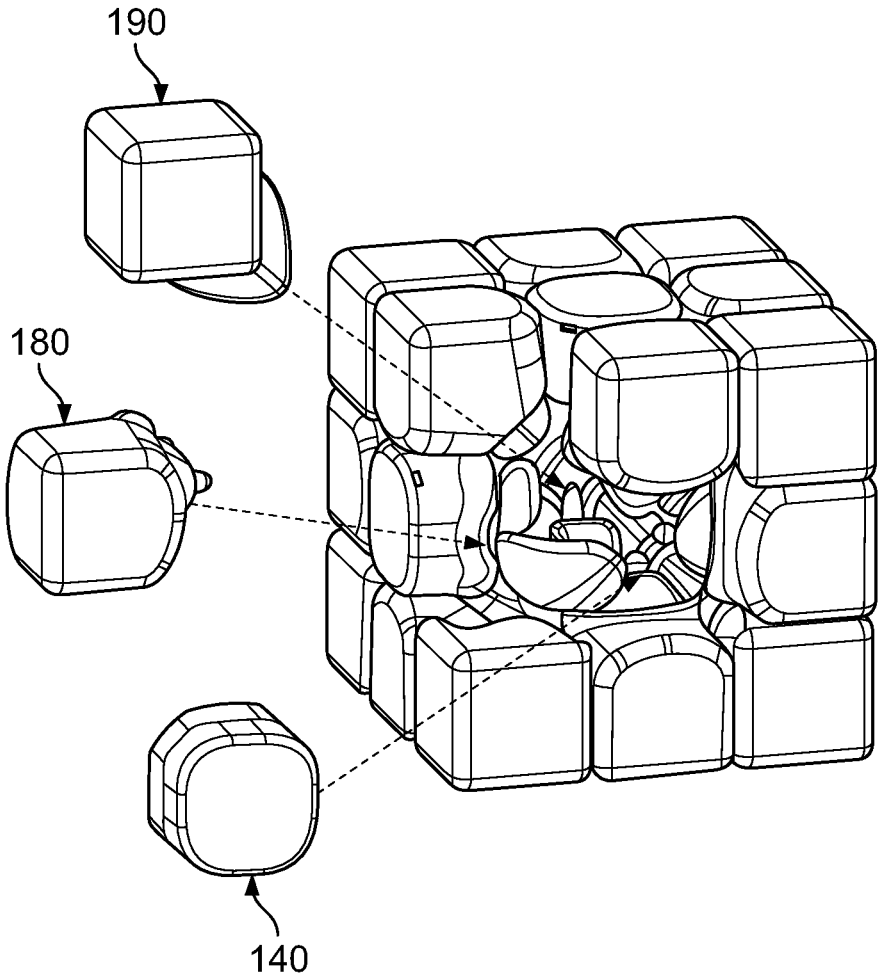
FIGS. 8 and 9 show illustrative examples of a partially assembled puzzle cube in accordance with some embodiments of the disclosed subject matter.
Figure 9:
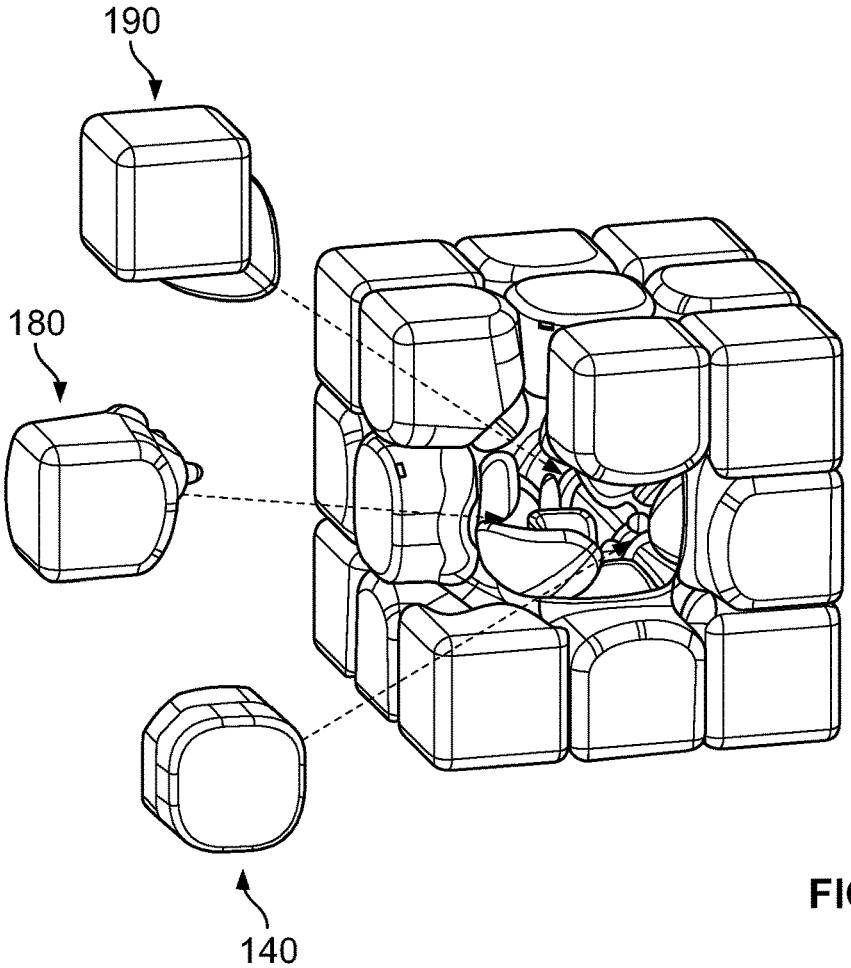

It should be also noted that, when assembling the puzzle cube, the multiple protrusion structures from each of the eight corner blocks and the multiple ridge structures from each of the multiple edge blocks forms a spherical core that surrounds the central core assembly. Portions of the spherical core within the puzzle cube are shown in FIGS. 8 and 9. For example, FIGS. 8 and 9 show illustrative examples of a partially assembled puzzle cube in accordance with some embodiments of the disclosed subject matter, where the spherical core within the puzzle cube is shown.

In some embodiments, corner block 190 can include one or more extrusion regions 430 that are formed on an interior portion of corner block 190. It should be noted that, in some embodiments, the one or more extrusion regions 430 can inhibit corner block 190 on puzzle cube from performing a twisting motion when being rotated about the central core assembly. That is, corner block 190 can be formed with an anti-popping structure that inhibits corner blocks 190 from popping when manipulating an assembled puzzle cube.

It should be noted that a 3×3 puzzle cube can include eight corner blocks.

Figure 10:
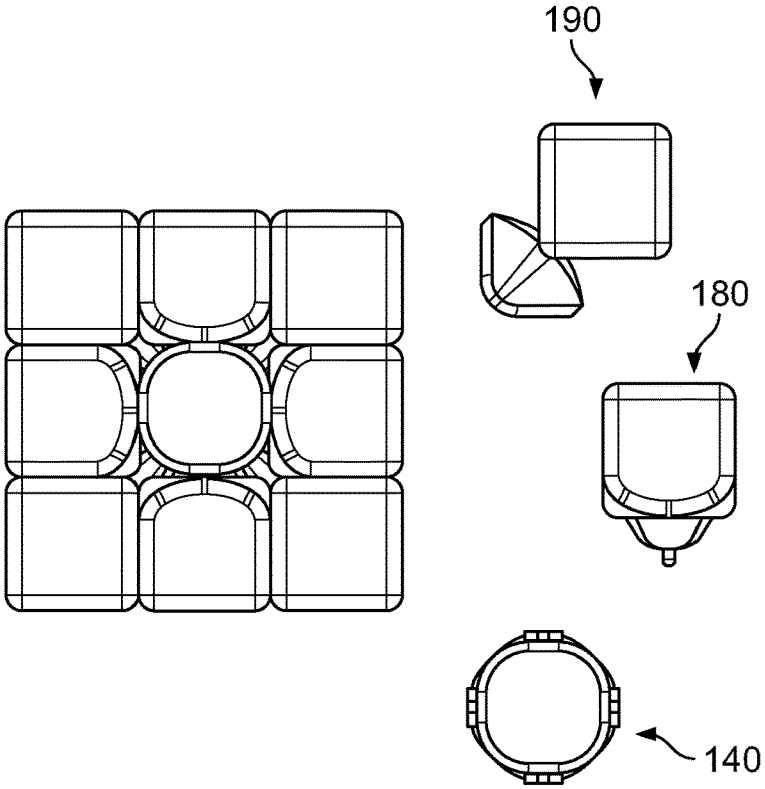
FIG. 10 shows an illustrative example of a surface layer of the puzzle cube that includes corner blocks, edge blocks, and a center block in accordance with some embodiments of the disclosed subject matter.
Figure 11:
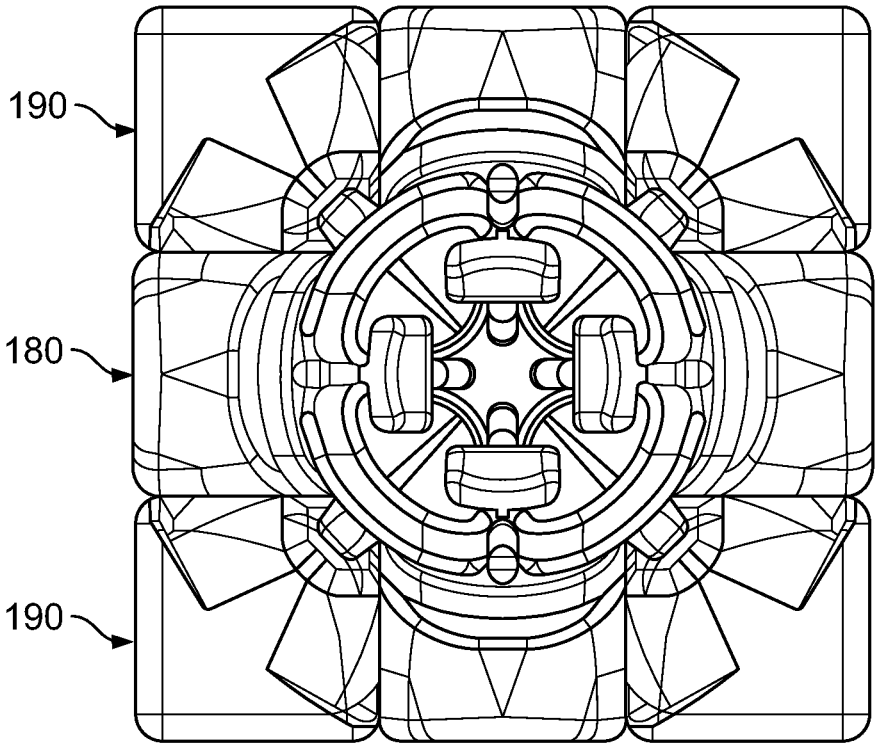
FIG. 11 shows an illustrative top-down view of the puzzle cube layer shown in FIG. 7 in accordance with some embodiments of the disclosed subject matter.
Figure 12:
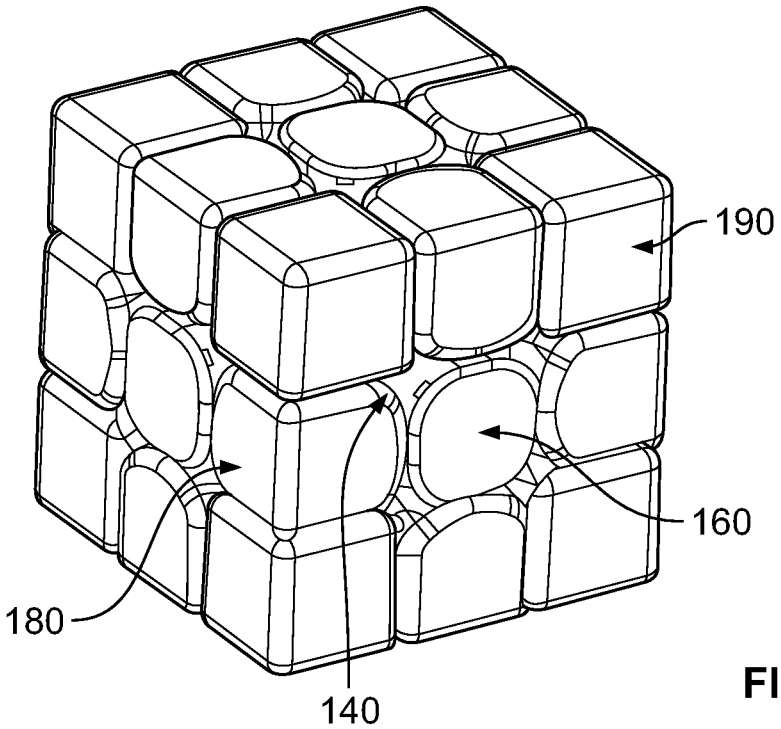
FIG. 12 shows an illustrative perspective view of the assembled puzzle cube that includes corner blocks, edge blocks, and center blocks in accordance with some embodiments of the disclosed subject matter.

As shown in FIGS. 10 and 12, a puzzle cube can be assembled that includes multiple corner blocks, multiple edge blocks, and multiple center blocks. For example, FIG. 10 shows an illustrative plan view of a surface layer of the puzzle cube that includes corner blocks 190, edge blocks 180, and a center block 140 in accordance with some embodiments of the disclosed subject matter. In another example, FIG. 12 shows an illustrative perspective view of the assembled puzzle cube that includes corner blocks 190, edge blocks 180, and center blocks 140 in accordance with some embodiments of the disclosed subject matter.

The puzzle cube can include a central core assembly, multiple center blocks, multiple edge blocks, and multiple corner blocks that are fitted together to form the puzzle cube having a spherical inner core. It should be noted that, in a 3×3 puzzle cube described herein, such a puzzle cube can include six center blocks, twelve edge blocks, and eight corner blocks, where each center block has one face, each edge block has two faces, and each corner block has three faces (for a total of fifty-four faces on the puzzle cube or nine faces per side of the puzzle cube).

Upon assembling the puzzle cube as shown in FIGS. 10 and 12, the puzzle cube can be used by rotating a row of cubic elements about the central core assembly (e.g., three orthogonal axes).

In some embodiments, the puzzle cube can include magnetic elements. Magnetic elements can, for example, provide resistance or feedback when manipulating the puzzle cube such that particular rotations are achieved. In another example, magnetic elements can provide stability of the puzzle cube as each turn of the puzzle cube is made.

In some embodiments, the puzzle cube can include magnetic elements positioned within particular elements of the puzzle cube. For example, in some embodiments, a first set of magnetic elements can be placed or affixed in magnetic insertion regions formed within the protrusion structure of a corner block and a second set of magnetic elements can be placed or affixed in magnetic insertion regions formed within the ridge structure of an edge block, where the first set of magnetic elements can be positioned to magnetically align with the second set of magnetic elements. In a more particular example, each magnetic insertion region can be formed within a block of the puzzle cube to accommodate the placement of a magnetic element (e.g., which can be replaced with magnetic elements of varying strength, varying polarities, etc.).

Although the embodiments described herein generally describe magnetic insertion regions formed on the protrusion structure of a corner block and the ridge structure of an edge block, this is merely illustrative. It should be noted that magnetic elements can be positioned within the internal elements of any suitable puzzle. For example, in a puzzle cube that is composed of a combination of blocks connected to a central core, one or more internal connection portions of a block (e.g., a wing, a protrusion, a plate, a flange, an engagement assembly, etc.) can include one or more magnetic insertion regions that are formed within the one or more internal connection portions in which a magnetic element can be placed. In another example, in a puzzle structure that includes edge blocks and corner blocks (e.g., edge blocks and corner blocks having different internal connection portions than those shown in FIGS. 3A, 3B, 4A, and 4B), magnetic insertion regions can be formed on the internal connection portions of those edge blocks and corner blocks in which magnetic elements of a particular magnetic strength can be placed within these magnetic insertion regions. In continuing this example, the magnetic insertion regions in an edge block can be aligned with the magnetic insertion regions in a corner block such that a particular magnetic attractive force is obtained when a magnet in a corner block is aligned with a magnet in an edge block.

In some embodiments, the magnetic insertion regions in each of the corner blocks and the edge blocks can be formed such that a magnetic element placed within a corner block can align with a magnetic element placed within an edge block. In continuing this example, the magnetic element placed within the corner block can magnetically couple with the magnetic element placed within the edge block such that the corresponding edge and corner blocks are configured to rotate a particular amount about the central core assembly. It should be noted that the magnetic element placed within the corner block and the magnetic element placed within the edge block can have opposing polarities such that an attractive force is generated between the magnetic elements.

It should be noted that the magnetic insertion regions can be formed at any suitable location on each of the corner blocks and each of the edge blocks. For example, the magnetic insertion regions in a corner block can be distributed around the corner block base of the protrusion structure. Alternatively, in another example, the corner block base of the protrusion structure can include a single magnetic insertion region that receives one magnetic element. In another example, the magnetic insertion region in an edge block can be formed beneath the edge track assembly, where one or more magnetic insertion regions are formed within a bottom face of the plate lip structure.

It should also be noted that, although the embodiments described herein generally show cylinder or disc-shaped magnets being placed within the magnetic insertion regions, the magnetic insertion regions can be formed to accommodate magnets of any suitable shape. For example, a magnetic insertion region can be cube-shaped to accommodate a cube-shaped magnet. In another example, a magnetic insertion region can be formed to accommodate a variety of differently-shaped magnets (e.g., square magnets, bar magnets, disc-shaped magnets, ring-shaped magnets, etc.).

Figure 13A:
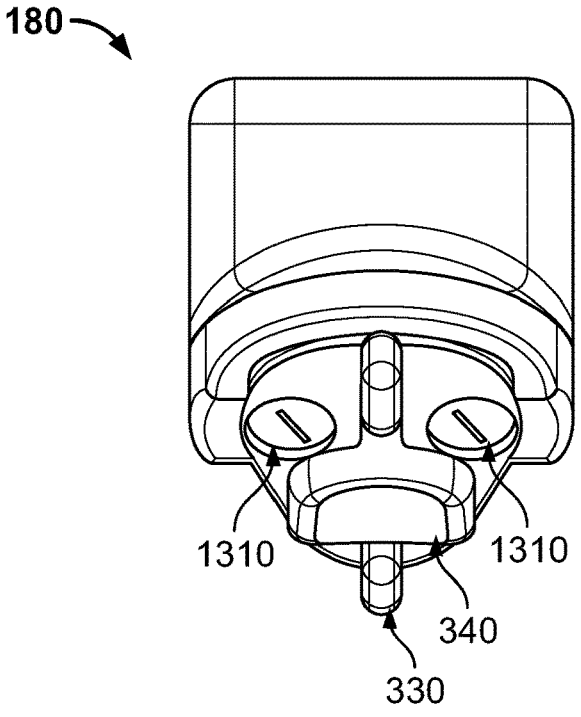
FIGS. 13A and 13B show illustrative examples of magnetic elements placed or affixed in magnetic insertion regions formed within an edge block of the puzzle cube in accordance with some embodiments of the disclosed subject matter.
Figure 13B:
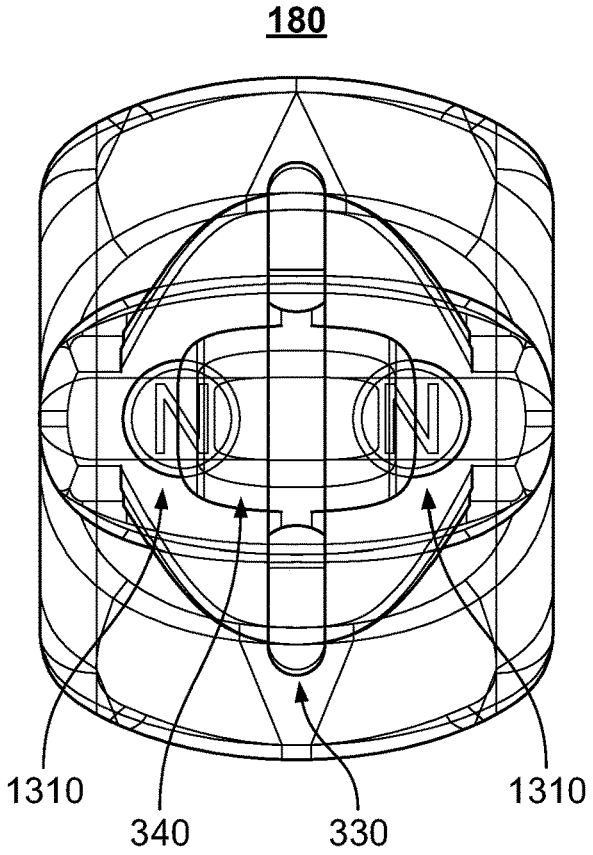

FIGS. 13A and 13B show illustrative examples of magnetic elements placed or affixed in magnetic insertion regions formed within an edge block of the puzzle cube in accordance with some embodiments of the disclosed subject matter. As shown, two magnetic insertion regions 1310 are formed within an inner surface 350 of an edge block 180. In continuing this example, the magnetic insertion regions 1310 of edge block 180 can be formed in the areas in which a protrusion structure of a corner block is to be received, where a first magnetic insertion region 1310 is formed on one end of edge track member 330 and a second and corresponding magnetic insertion region 1310 is formed on an opposing end of edge track member 330.

In a more particular example, magnetic insertion regions 1310 can be formed in a post-processing procedure in which a region is drilled into an inner surface (e.g., a bottom edge face) of edge block 180 to accommodate a magnetic element. It should be noted that any suitable number of magnetic insertion regions 1310 can be formed within edge block 180. For example, four magnetic insertion regions 1310 can be formed in place of the two magnetic insertion regions 1310 shown in FIGS. 13A and 13B (e.g., with smaller magnetic elements placed within the four magnetic insertion regions). In another example, multiple magnetic insertion regions 1310 can be formed along the periphery of inner surface 350 of edge block 180. In yet another example, a single magnetic insertion region 1310 can be formed within edge block 180 to align with another magnetic insertion region on a corner block.

Figure 14A:
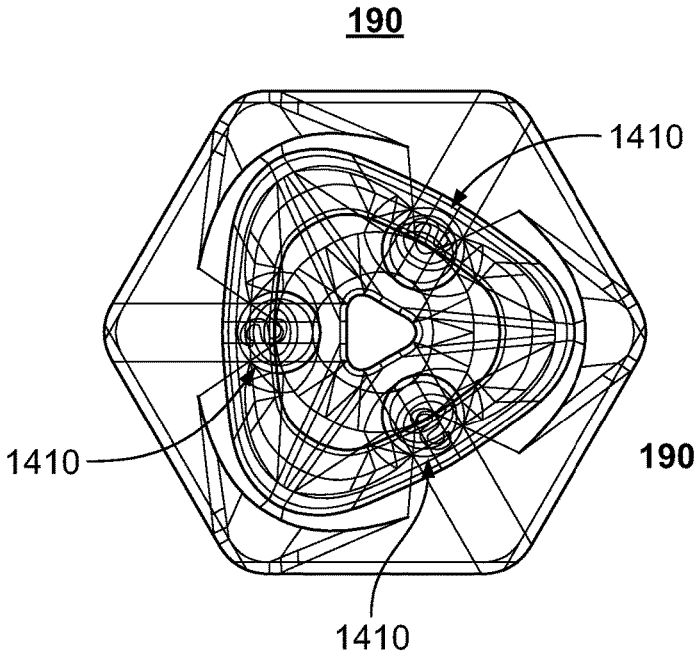
FIGS. 14A, 14B, and 14C shows an illustrative example of magnetic elements placed or affixed in magnetic insertion regions formed within a corner block of the puzzle cube in accordance with some embodiments of the disclosed subject matter.
Figure 14B:
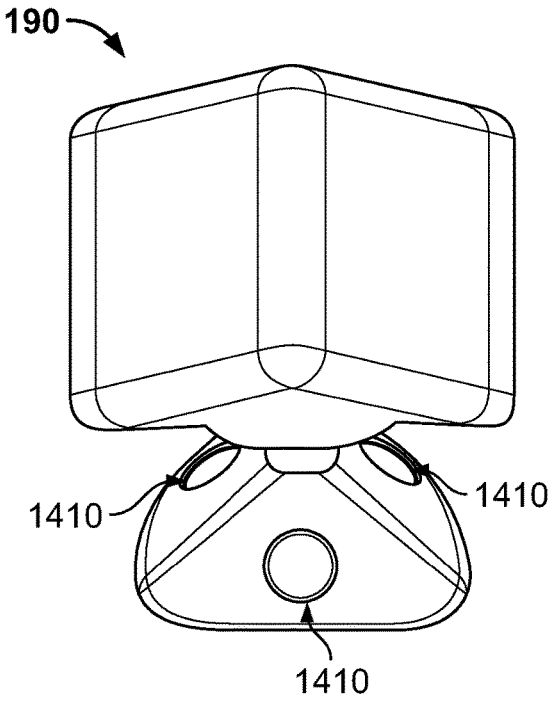
Figure 14C:
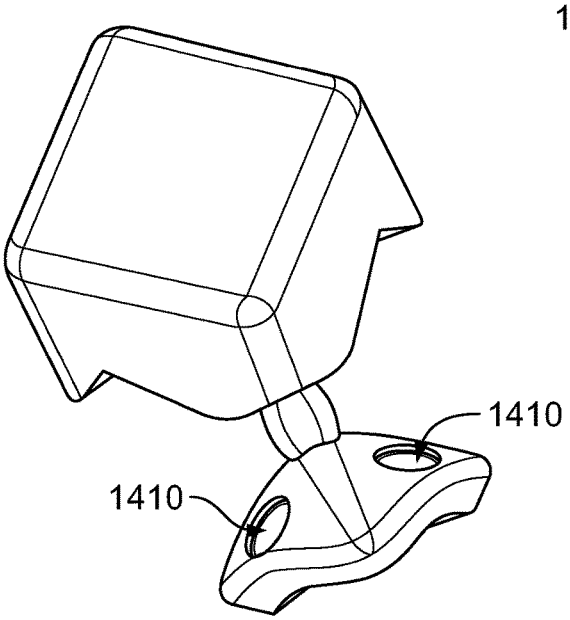

Turning to FIGS. 14A-14C, FIGS. 14A-14C show illustrative examples of magnetic elements placed or affixed in magnetic insertion regions formed within a corner block of the puzzle cube in accordance with some embodiments of the disclosed subject matter. As shown, three magnetic insertion regions 1410 are formed within an outer surface of corner block base 420 of the protrusion structure on corner block 190. In a more particular example, the three magnetic insertion regions 1410 are equally distributed around the periphery of an outer surface of cornerback base 420 of the protrusion structure on corner block 190. In continuing this example, the magnetic insertion regions 1410 of corner block 190 can be formed in the areas in which a ridge structure or an edge track member of an edge block is to be received.

In a more particular example, magnetic insertion regions 1410 can be formed in a post-processing procedure in which a region is drilled into an outer surface of corner block 190 to accommodate a magnetic element. It should be noted that any suitable number of magnetic insertion regions 1410 can be formed within corner block 190. For example, six magnetic insertion regions 1410 can be formed in place of the three magnetic insertion regions 1410 shown in FIGS. 14A-14C. In another example, a single magnetic insertion region 1410 can be formed within corner block 190 to align with another magnetic insertion region on an edge block.

It should be noted that, although the embodiments described herein show a magnetic element being affixed within each magnetic insertion region, these magnetic elements can be removed and/or replaced. For example, in some embodiments, the magnetic elements can be removed from one or more of the magnetic insertion regions. In another example, in some embodiments, the magnetic elements can be removed from one or more of the magnetic insertion regions and replaced with differing magnetic elements—e.g., magnetic elements with different polarities, magnetic elements with different magnetic moments, etc.

Figure 15:
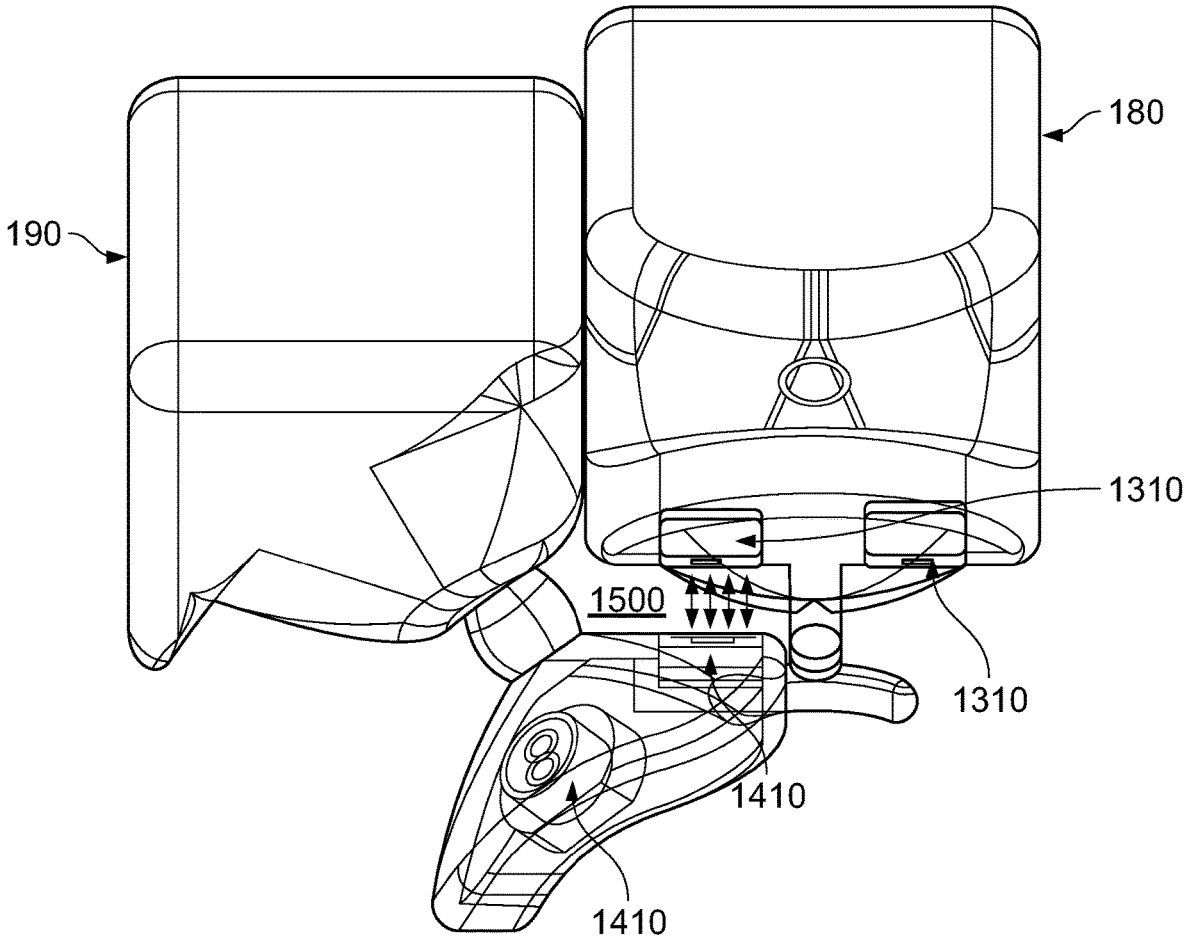
FIG. 15 shows an illustrative example of a first magnetic element of a corner block of the puzzle cube interacting with a second magnetic element of an edge block of the puzzle cube, where the first magnetic element and the second magnetic element have opposing polarities, in accordance with some embodiments of the disclosed subject matter.

FIG. 15 shows an illustrative example of a first magnetic element of a corner block of the puzzle cube interacting with a second magnetic element of an edge block of the puzzle cube, where the first magnetic element and the second magnetic element have opposing polarities, in accordance with some embodiments of the disclosed subject matter. As shown, a magnetic element placed within a magnetic insertion region 1410 of corner block 190 can align with a magnetic element placed within a magnetic insertion region 1510 of edge block 180, where an attractive force between the magnetic elements is generated (e.g., due to opposing magnetic field polarities in the magnetic elements). This can, for example, cause a particular amount of rotation or a decreased probability of an over-rotation to be made when manipulating the puzzle cube having these magnetic elements disposed within the puzzle cube. It should be noted that the attractive forces can be modified by, for example, removing one or more magnetic elements from the magnetic insertion regions, replacing one or more magnetic elements from the magnetic insertion regions with magnetic elements having differing properties, etc.

Accordingly, a puzzle cube and methods for making the same are provided.

Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways.

What is claimed is:

1. A puzzle cube comprising:

a central core assembly including a center cross member having six arms perpendicular to each other, wherein each arm is connected to an assembly member that connects the center cross member with one of a plurality of center blocks;

the plurality of center blocks, wherein each center block includes a plurality of wings formed along a base portion of the center block;

a plurality of edge blocks, wherein each edge block includes a ridge structure that is formed to fit with the plurality of wings of the center block and wherein a first plurality of magnetic elements are positioned within each edge block; and a plurality of corner blocks, wherein:

(i) each corner block includes a protrusion structure that is formed to fit with the plurality of wings of the center block;

(ii) a second plurality of magnetic elements are positioned within each corner block, the protrusion structure of each corned block includes one of the second plurality of magnetic elements, and at least a first magnetic element of the first plurality of magnetic elements positioned within each edge block is positioned to align with at least a second magnetic element of the second plurality of magnetic elements positioned within each corner block; and (iii) the protrusion structure of each corner block is cup-shaped, a plurality of magnetic insertion regions are formed within the cup-shaped protrusion structure, and each magnetic element in the second plurality of magnetic elements is placed within each of the plurality of magnetic insertion regions;

wherein:

an edge track assembly that includes an edge track member and an edge holder member is formed on the ridge structure of each edge block;

two protrusion structures of two corner blocks of the plurality of corner blocks are positioned to abut opposing ends of the edge track member of the edge track assembly of the edge block; and the edge holder member of the edge track assembly stabilizes the two protrusion structures that are positioned to abut opposing ends of the edge track member of the edge track assembly of the edge block.

2. The puzzle cube of claim 1, wherein the assembly member is a screw having a screw head and wherein each arm in the center cross member receives the screw.

3. The puzzle cube of claim 2, further comprising a lid structure that covers an interior of the center block in which the screw connects the base portion of the center block with an arm of the center cross member.

4. The puzzle cube of claim 2, further comprising a compression spring that is positioned between the screw head of the screw and the base portion of the center block.

5. The puzzle cube of claim 1, wherein each of the plurality of wings of the center block is formed along an edge of the base portion of the center block.

6. The puzzle cube of claim 1, wherein the ridge structure formed on each of the plurality of edge blocks includes a plate lip structure that is formed beneath the edge track assembly and wherein a surface of the plate lip structure abuts the plurality of wings of the center block.

7. The puzzle cube of claim 6, wherein the protrusion structure of each of the plurality of corner blocks includes a corner block base formed on a post member extending from the corner block and wherein each corner block base from the plurality of corner blocks, when positioned to abut the edge track member of each of the plurality of edge blocks, and each plate lip structure from the plurality of edge blocks forms a spherical core that surrounds the central core assembly.

8. The puzzle cube of claim 1, wherein each of the plurality of corner blocks includes a plurality of extrusions that are formed in an interior portion of the corner block and wherein the plurality of extrusions inhibit the corner block from performing a twisting motion when being rotated about the central core assembly.

9. The puzzle cube of claim 1, wherein the protrusion structure of each of the plurality of corner blocks includes a corner block base formed on a post member extending from the corner block and wherein each corner block base from the plurality of corner blocks, when positioned to abut the edge track member of each of the plurality of edge blocks, forms a spherical core that surrounds the central core assembly.

10. The puzzle cube of claim 1, wherein the protrusion structure of each of the plurality of corner blocks is cup-shaped and wherein an outer surface of the cup-shaped protrusion structure is formed to fit with the plurality of wings of the center block.

11. The puzzle cube of claim 1, wherein the first magnetic element and the second magnetic element are configured to magnetically couple such that corresponding blocks are configured to rotate a particular amount about the central core assembly.

12. The puzzle cube of claim 1, wherein the first magnetic element and the second magnetic element have opposing polarities such that an attractive force is generated between the first magnetic element and the second magnetic element.

13. The puzzle cube of claim 1, wherein three magnetic insertion regions are formed within the cup-shaped protrusion structure that each accommodates one magnetic element of the first second plurality of magnetic elements.

14. The puzzle cube of claim 1, wherein the ridge structure formed on each of the plurality of edge blocks includes a plate lip structure that is formed beneath the edge track assembly, wherein a second plurality of magnetic insertion regions are formed within a bottom face of the plate lip structure, and wherein each magnetic element in the first plurality of magnetic elements is placed within each of the second plurality of magnetic insertion regions.

15. The puzzle cube of claim 14, wherein two magnetic insertion regions are formed within the bottom face of the plate lip structure that each accommodates one magnetic element of the first plurality of magnetic elements.

16. The puzzle cube of claim 1, wherein the puzzle cube includes six center blocks of the plurality of center blocks, twelve edge blocks of the plurality of edge blocks, and eight corner blocks of the plurality of corner blocks, wherein each of the plurality of center blocks has one face, wherein each of the plurality of edge blocks has two faces, and wherein each of the plurality of corner blocks has three faces.

17. A puzzle cube comprising:

a central core assembly including a center cross member having six arms perpendicular to each other, wherein each arm is connected to an assembly member that connects the center cross member with one of a plurality of center blocks;

the plurality of center blocks;

a plurality of edge blocks, wherein each edge block includes a first puzzle connection structure, wherein the first puzzle connection structure includes a ridge structure that has a plate lip structure, wherein a first magnetic region is formed within a bottom face of the plate lip structure of the first puzzle connection structure, and wherein a first magnet is placed within the first magnetic region; and a plurality of corner blocks, wherein each corner block includes a second puzzle connection structure, wherein the second puzzle connection structure includes a cup-shaped protrusion structure, wherein a second magnetic region is formed within the cup-shaped protrusion structure of the second puzzle connection structure, and wherein a second magnet is placed within the second magnetic region;

wherein:

the first puzzle connection structure of one of the plurality of edge blocks and the second puzzle connection structure of one of the plurality of corner blocks are positioned to connect with one of the plurality of center blocks; and the first magnet positioned within the first magnetic region is aligned with the second magnet positioned within the second magnetic region.

18. A puzzle cube comprising:

a central core assembly including a center cross member having six arms perpendicular to each other, wherein each arm is connected to an assembly member that connects the center cross member with one of a plurality of center blocks;

the plurality of center blocks, wherein each center block includes a plurality of wings formed along a base portion of the center block;

a plurality of edge blocks, wherein each edge block includes a ridge structure that is formed to fit with the plurality of wings of the center block and wherein a first plurality of magnetic elements are positioned within each edge block; and a plurality of corner blocks, wherein each corner block includes a protrusion structure that is formed to fit with the plurality of wings of the center block, wherein a second plurality of magnetic elements are positioned within each corner block, wherein the protrusion structure of each corner block includes the second plurality of magnetic elements, and wherein at least a first magnetic element of the first plurality of magnetic elements positioned within each edge block is positioned to align with at least a second magnetic element of the second plurality of magnetic elements positioned within each corner block;

wherein:

an edge track assembly that includes an edge track member and an edge holder member is formed on the ridge structure of each edge block, wherein the ridge structure formed on each edge block includes a plate lip structure that is formed beneath the edge track assembly, wherein a plurality of magnetic insertion regions are formed within a bottom face of the plate lip structure, and wherein each magnetic element in the first plurality of magnetic elements is placed within each of the plurality of magnetic insertion regions;

two protrusion structures of two corner blocks of the plurality of corner blocks are positioned to abut opposing ends of the edge track member of the edge track assembly of the edge block; and the edge holder member of the edge track assembly stabilizes the two protrusion structures that are positioned to abut opposing ends of the edge track member of the edge track assembly of the edge block.

19. The puzzle cube of claim 18, wherein two magnetic insertion regions are formed within the bottom face of the plate lip structure that each accommodates one magnetic element of the second plurality of magnetic elements.

20. The puzzle cube of claim 18, wherein the protrusion structure of each of the plurality of corner blocks is cup-shaped, wherein a second plurality of magnetic insertion regions are formed within the cup-shaped protrusion structure, and wherein each magnetic element in the second plurality of magnetic elements is placed within each of the second plurality of magnetic insertion regions.

21. The puzzle cube of claim 20, wherein three magnetic insertion regions are formed within the cup-shaped protrusion structure that each accommodates one magnetic element of the second plurality of magnetic elements.

* * * * *